United States Patent [19]

Klomp

[11] Patent Number: 4,958,771

[45] Date of Patent: Sep. 25, 1990

[54] INJECTION NOZZLE

[75] Inventor: Edward D. Klomp, Mount Clemens, Mich.

[73] Assignee: General Motors Corporation, Detroit, Mich.

[21] Appl. No.: 369,507

[22] Filed: Jun. 21, 1989

[51] Int. Cl.[5] ..... F02M 61/08; B05B 1/32

[52] U.S. Cl. ..... 239/453; 239/533.12

[58] Field of Search ..... 239/452, 453, 456, 459, 239/533.12

[56] References Cited

U.S. PATENT DOCUMENTS 2,063,709 12/1936 Taylor ..... 239/453

4,197,997 4/1980 Wu et al. ..... 239/533.12 X 4,394,972 7/1983 Potter ..... 239/456 X

*Primary Examiner*—Andres Kashnikow

*Assistant Examiner*—William Grant

*Attorney, Agent, or Firm*—Charles K. Veenstra

[57] ABSTRACT

An injection nozzle has a flow splitter interposed between its valve head and its valve seat. An operating disc responsive to pressure in the nozzle inlet varies the position of the flow splitter between the valve seat and the valve head, maintaining the flow splitter engaged with the valve seat under low flow conditions, engaged with the valve head under high flow conditions, and spaced from both the valve seat and the valve head under intermediate flow conditions.

1 Claim, 5 Drawing Sheets

INJECTION NOZZLE

TECHNICAL FIELD

This invention relates to an nozzle for delivering a charge directly into an engine combustion chamber.

DETAILED DESCRIPTION

Figure 1:
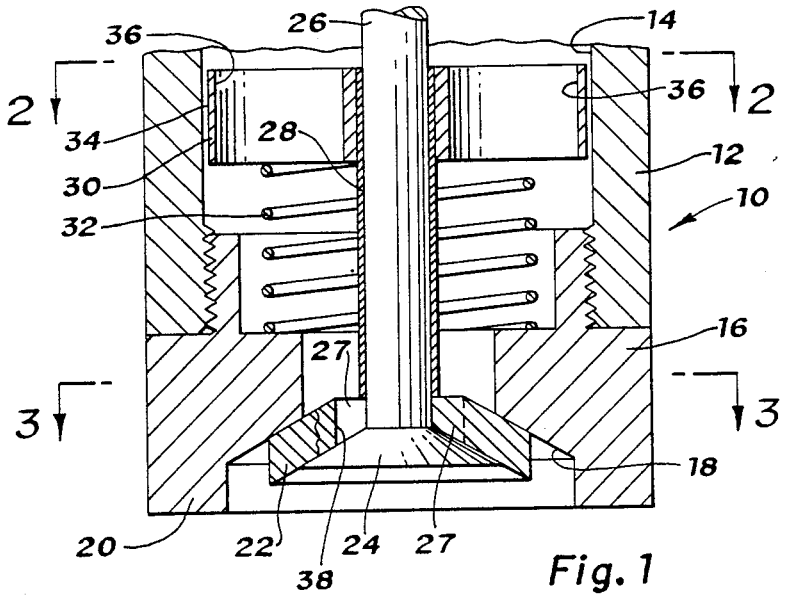
FIG. 1 is a schematic sectional view of an injection nozzle employing this invention.
Figure 2:
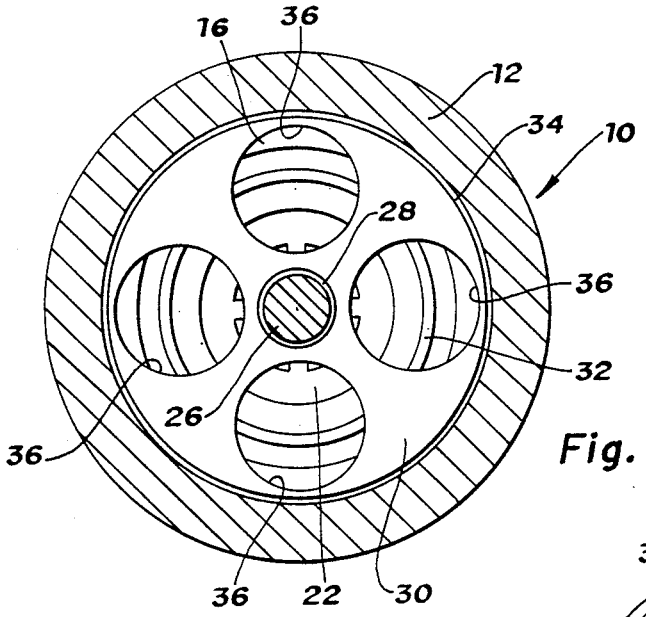
FIG. 2 is a view, indicated by the line 2—2 of FIG. 1, showing an actuating disc.
Figure 3:
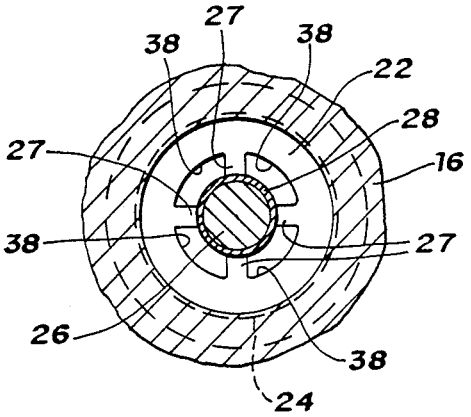
FIG. 3 is a view, indicated by the line 3—3 of FIG. 1, showing a flow splitter.

Referring to the drawings, a nozzle 10 has a body 12 that receives a fuel-air charge through an inlet passage 14 and discharges the charge through a tip 16. Tip 16 has a valve seat 8 surrounded by a shroud 20.

A flow splitter 22 is interposed between valve seat 18 and a valve head 24. Valve head 24 is positioned by a valve stem 26, and flow splitter 22 has ribs 27 supported by a tube 28 surrounding valve stem 26. Tube 26 depends from an operating disc 30. A spring 32 acts on disc 30 to bias flow splitter 22 against valve seat 18. A cylindrical flange 34 on disc 30 keeps disc 30 properly aligned in inlet passage 14.

Figure 4:
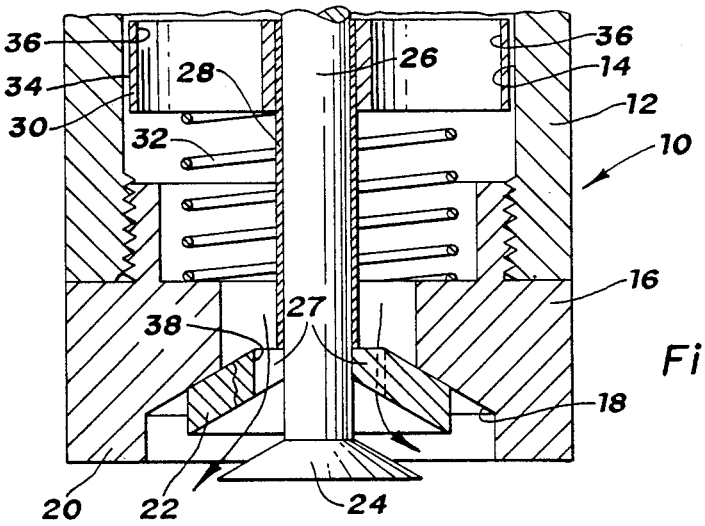
FIG. 4 is a view of the FIG. 1 nozzle opened under low flow conditions.

To initiate flow under low flow conditions, valve stem 26 disengages valve head 24 from flow splitter 22, and the fuel-air charge passes from inlet passage 14 through openings 36 in operating disc 30 and around tube 28, then through openings 38 in flow splitter 22, and is discharged between valve head 24 and flow splitter 22 as shown in FIG. 4.

Figure 5:
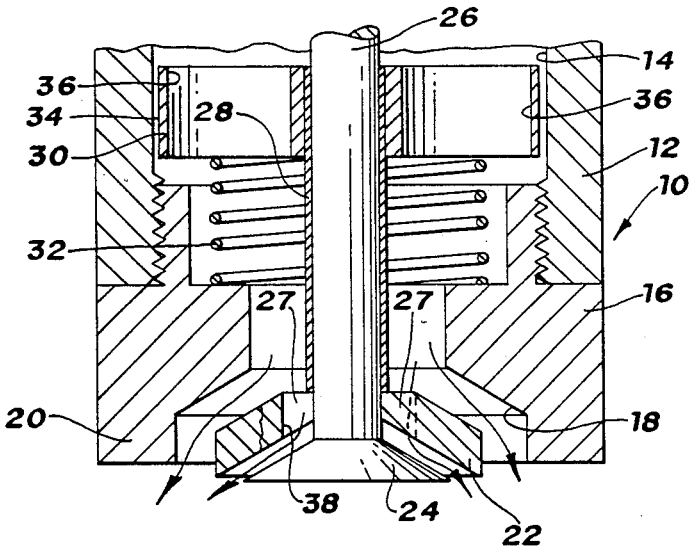
FIG. 5 is a view of the FIG. 1 nozzle opened under medium flow conditions.

Under medium flow conditions where the pressure of the fuel-air charge in inlet passage 14 is somewhat increased, operating disc 30 is displaced against the bias of spring 32 to disengage flow splitter 22 from valve seat 18. The fuel-air charge thereupon passes through openings 36 in operating disc 30 and around tube 28, then both through openings 38 in flow splitter 22 and between flow splitter 22 and valve seat 18, and accordingly is discharged both between valve head 24 and flow splitter 22 and between flow splitter 22 and valve seat 18 as shown in FIG. 5. The discharge between flow splitter 22 and valve seat 18 reduces the cone angle of the total discharge as is desired under medium flow conditions.

Figure 6:
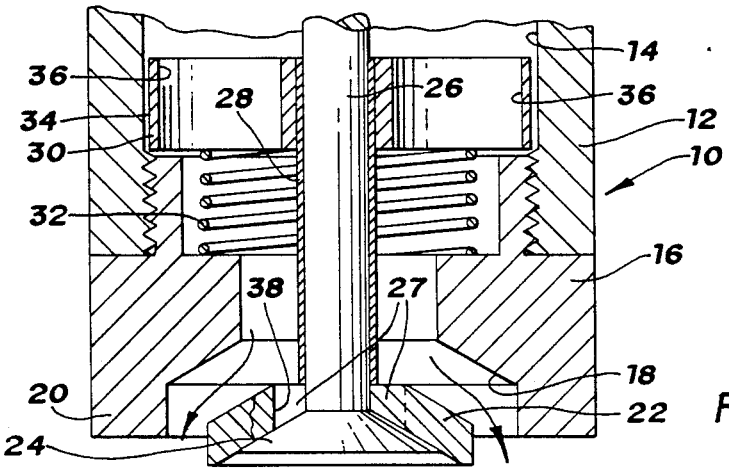
FIG. 6 is a view of the FIG. 1 nozzle opened under high flow conditions.

Under high flow conditions where the pressure of the fuel-air charge in inlet passage 14 is substantially increased, operating disc 30 is further displaced against the bias of spring 32 to keep flow splitter 22 engaged with valve head 24. The fuel-air charge thereupon passes through openings 36 in operating disc 30 and around tube 28, and is then discharged directly between flow splitter 22 and valve seat 18 as shown in FIG. 6. Discharge of the entire fuel-air charge between flow splitter 22 and valve seat 18 minimizes the cone angle of the total discharge as is desired under high flow conditions.

I claim:

1. An injection nozzle having an inlet, a valve head, a valve seat, a flow splitter interposed between the valve head and the valve seat, and an operating disc responsive to pressure in the inlet and connected to the flow splitter for varying the position of the flow splitter between the valve seat and the valve head, said operating disc maintaining the flow splitter engaged with the valve seat under low flow conditions, engaged with the valve head under high flow conditions, and spaced from both the valve seat and the valve head under intermediate flow conditions, and wherein said operating disc has a flange upstream thereof cooperating with said inlet to keep said operating disc aligned in said inlet, said valve head has a valve stem, and said operating disc is connected to said flow splitter by a tube that guides said valve stem to keep said valve head aligned with said valve seat, said tube being radially spaced from said inlet to permit flow around said tube to said valve head, valve seat, and flow splitter.

* * * * *